US007742362B2

(12) United States Patent
Corthesy et al.

(10) Patent No.: US 7,742,362 B2
(45) Date of Patent: Jun. 22, 2010

(54) TIMEPIECE COMPRISING AN ALARM

(75) Inventors: Yves Corthesy, La Chaux-de-Fonds (CH); Jean-Pierre Charpier, Morteau (FR)

(73) Assignee: LVMH Swiss Manufactures SA, La Chaux-De-Fonds (CH)

( * ) Notice: Subject to any disclaimer, the term of this patent is extended or adjusted under 35 U.S.C. 154(b) by 364 days.

(21) Appl. No.: 11/910,105

(22) PCT Filed: Mar. 31, 2006

(86) PCT No.: PCT/EP2006/061239

§ 371 (c)(1),
(2), (4) Date: Sep. 28, 2007

(87) PCT Pub. No.: WO2006/103289

PCT Pub. Date: Oct. 5, 2006

(65) Prior Publication Data

US 2008/0273426 A1 Nov. 6, 2008

(30) Foreign Application Priority Data

Mar. 31, 2005 (EP) ..... 05102568

(51) Int. Cl.
*G04B 23/02* (2006.01)
*G04B 21/00* (2006.01)

(52) U.S. Cl. ..... 368/72; 368/261; 368/269

(58) Field of Classification Search ..... 368/75, 368/72, 243, 244, 260, 261–262, 269–271
See application file for complete search history.

(56) References Cited

U.S. PATENT DOCUMENTS 916,953 A 3/1909 Lugrin 3,732,686 A 5/1973 Zaugg (Continued)

FOREIGN PATENT DOCUMENTS

CH 289113 2/1958

(Continued)

OTHER PUBLICATIONS

English translation of the Written Opinion of the International Searching Authority of PCT/EP2006/061239 which is related to subject application.

(Continued)

*Primary Examiner*—Vit W Miska
(74) *Attorney, Agent, or Firm*—Townsend M. Belser, Jr.; Nexsen Pruet, LLC

(57) ABSTRACT

A timepiece with an alarm mechanism having: a power source (24) which is locked when the mechanism is at rest and unlocked when the mechanism is in operation; an adjustment system which can be used to program the alarm time; and a trigger system that includes a control member (16) which controls the unlocking of the power source and a cam (10) which is kinematically connected to the movement and performs one revolution every 24 hours. The alarm mechanism also has a first striking train mechanism equipped with at least one hammer (54) arranged to strike at least one gong (56), and a second striking train mechanism equipped with at least one hammer (70) arranged to strike at least one non-resonant object (72), wherein the power source (24) drives one or the other of the striking train mechanisms.

8 Claims, 5 Drawing Sheets

U.S. PATENT DOCUMENTS

| | | | | |
|---|---|---|---|---|
| 3,869,855 | A * | 3/1975 | Sodler | 368/243 |
| 4,135,474 | A * | 1/1979 | Kaplan | 116/155 |
| 4,258,432 | A * | 3/1981 | Zafferri et al. | 368/250 |
| 4,271,498 | A * | 6/1981 | Zafferri et al. | 368/250 |
| 7,545,706 | B2 * | 6/2009 | Candaux | 368/243 |

FOREIGN PATENT DOCUMENTS

| | | |
|---|---|---|
| CH | 692067 | 1/2002 |
| EP | 1708050 A1 | 10/2006 |
| FR | 1166133 | 11/1958 |

OTHER PUBLICATIONS

International Search Report PCT/EP2006/0612539 related to subject application.

"Théorie de I'horlogerie" by Reymondin et al., Fédération des Ecoles Techniques, 1998, ISBN 2-940025-10-x, pp. 217 to 218.

DE1991230 is believed to be in the same family as non-English document CH692067 (C above).

Automated English Translation of above Foreign Patent (J) No. DE1991230 as obtained from website http://www.espacenet.com.

* cited by examiner

TIMEPIECE COMPRISING AN ALARM

BACKGROUND OF THE INVENTION

1) Field of the Invention

The present invention relates to the field of mechanical horology. It more particularly concerns a timepiece comprising an alarm mechanism, also known by the name "alarm clock".

2) Description of Related Art

Using the commonly accepted understanding of the term "alarm clock", a watch, particularly a bracelet watch, provided with such a mechanism comprises an alarm automatically triggered at a predetermined time. This function is provided by a module coupled with a conventional clockwork movement. Traditionally, it is equipped with:

- an independent power source, generally a barrel,
- an adjustment system which can be used to program the alarm time,
- a trigger system with three pins and slots, connected to the going train of the movement and actuating the alarm at the fixed time, and
- a striking mechanism to notify the wearer.

A traditional alarm watch mechanism is described in the book "Théorie de l'horlogerie" by Reymondin et al, Fédération des Ecoles Techniques, 1998, ISBN 2-940025-10-X, pages 217 to 218.

Alarm watches present several drawbacks, in particular that of not allowing one to control the duration of the alarm. Indeed, once triggered, the alarm continues until the barrel is completely disarmed. Moreover, to the applicant's knowledge, no alarm mechanism exists with which one can stop the alarm during operation, except by completely deactivating the alarm mode.

Moreover, some timepieces propose various operating modes and make it possible, in particular, to stop the alarm function. However, this choice is binary and lacks flexibility. Other situations may be considered, in particular in the case where the wearer wishes to be notified at the fixed time, but without those around him being bothered by the noise of the alarm.

SUMMARY OF THE INVENTION

The present invention aims to provide an alarm mechanism free of the abovementioned drawbacks. Thus, the duration of the alarm is determined and, furthermore, the wearer is able to interrupt it, without having to deactivate the alarm function. Moreover, the alarm also offers the possibility of operating in a discreet mode, in which the alarm produces a signal notifying the wearer without bothering those around him.

More precisely, the invention relates to a timepiece comprising an alarm mechanism which includes:

- a power source which is locked when the mechanism is at rest and unlocked when it is in operation,
- an adjustment system which can be used to program the alarm time,
- a trigger system comprising a control member which controls the unlocking of the power source and a cam which is kinematically connected to the movement and which performs one revolution every twenty-four hours.

According to the invention, the alarm mechanism also comprises a first striking mechanism which is equipped with at least one hammer that is intended to strike at least one gong and a second striking mechanism which is equipped with at least one hammer that is intended to strike at least one non-resonant object. The power source drives one or the other of the striking mechanisms.

According to one advantageous embodiment, the second striking mechanism also comprises a pinion kinematically connected to a power source, a to-and-fro cam driven by said pinion, a to-and-fro intermediate wheel kinematically connecting the pinion and the hammer, transforming a rotational movement of the to-and-fro cam into oscillation of the hammer.

Another aspect of the invention relates to an alarm mechanism for a timepiece movement, comprising:

- a power source which is locked when the mechanism is at rest and unlocked when it is in operation,
- an adjustment system which can be used to program the alarm time,
- a trigger system comprising a control member which controls the unlocking of the power source and only one cam kinematically connected to the movement and which performs one revolution every twenty-four hours, and
- a striking mechanism driven by the power source and which is equipped with at least one hammer intended to strike a gong or a non-resonant object.

Advantageously, the control member is provided with an arm ending with a first pin and the cam includes a slot intended to receive this pin to drive the unlocking of the power source.

BRIEF DESCRIPTION OF THE DRAWINGS

Other details will more clearly appear upon reading the following description, done in reference to the appended drawing in which.

DETAILED DESCRIPTION OF THE INVENTION

Figure 1A:
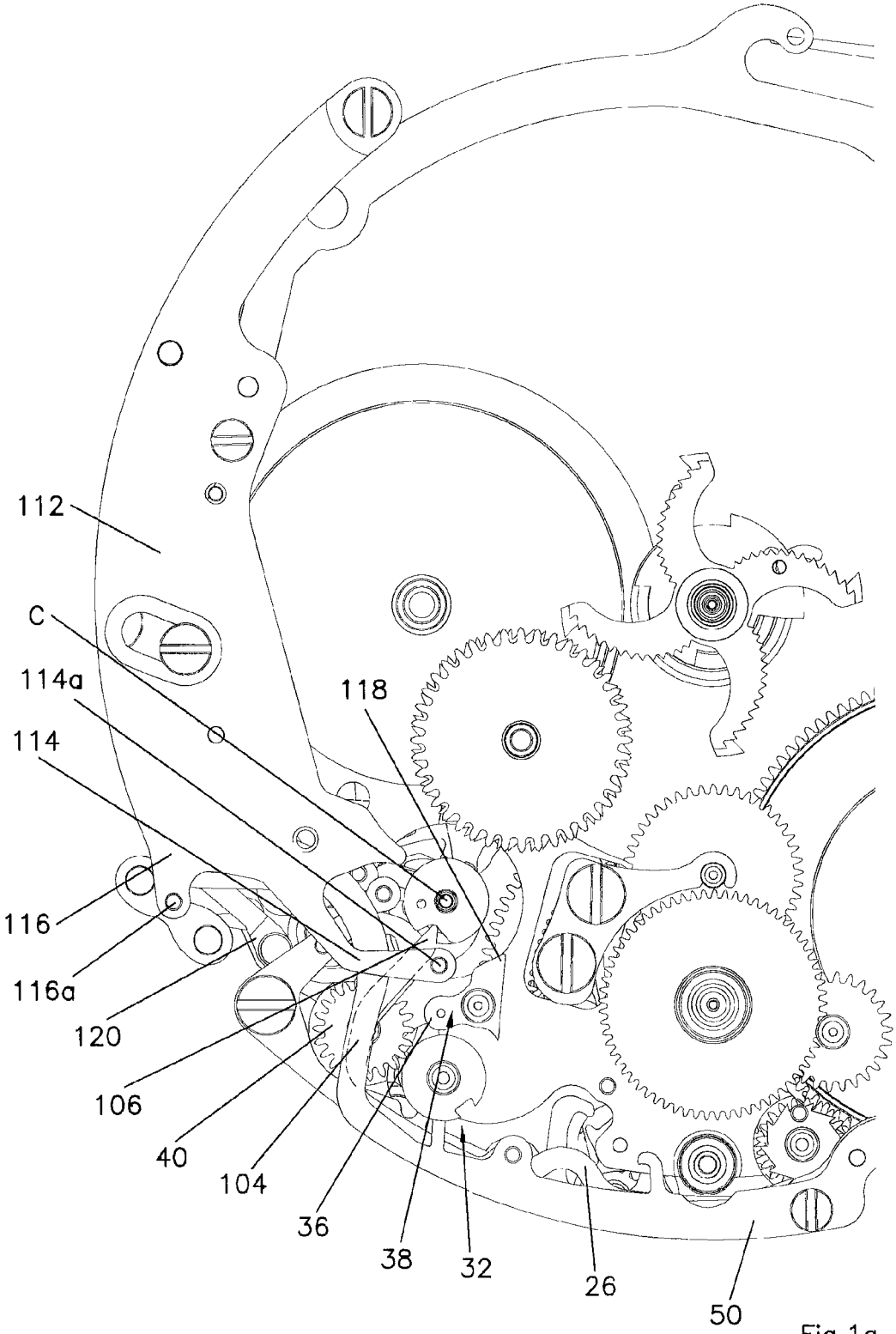
FIGS. 1*a* and 1*b* are top views of the mechanism at rest, the full view being divided between the two figures.
Figure 1B:
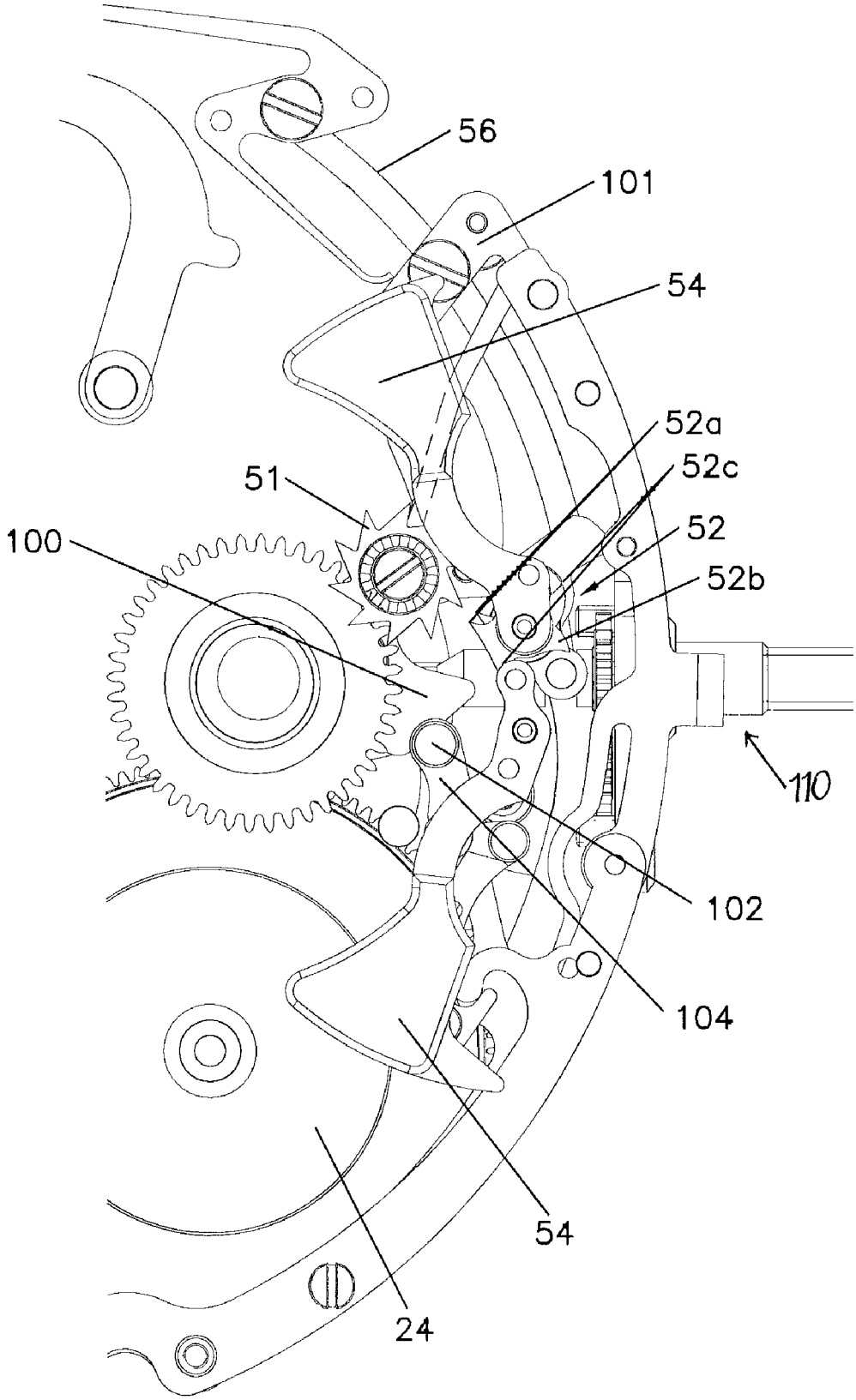

The alarm mechanism illustrated in FIG. 1 is placed in a traditional timepiece movement, the common elements of which are not shown in the drawing for reasons of clarity. Likewise, the plate on which the parts of the alarm are mounted is not illustrated.

Figure 2:
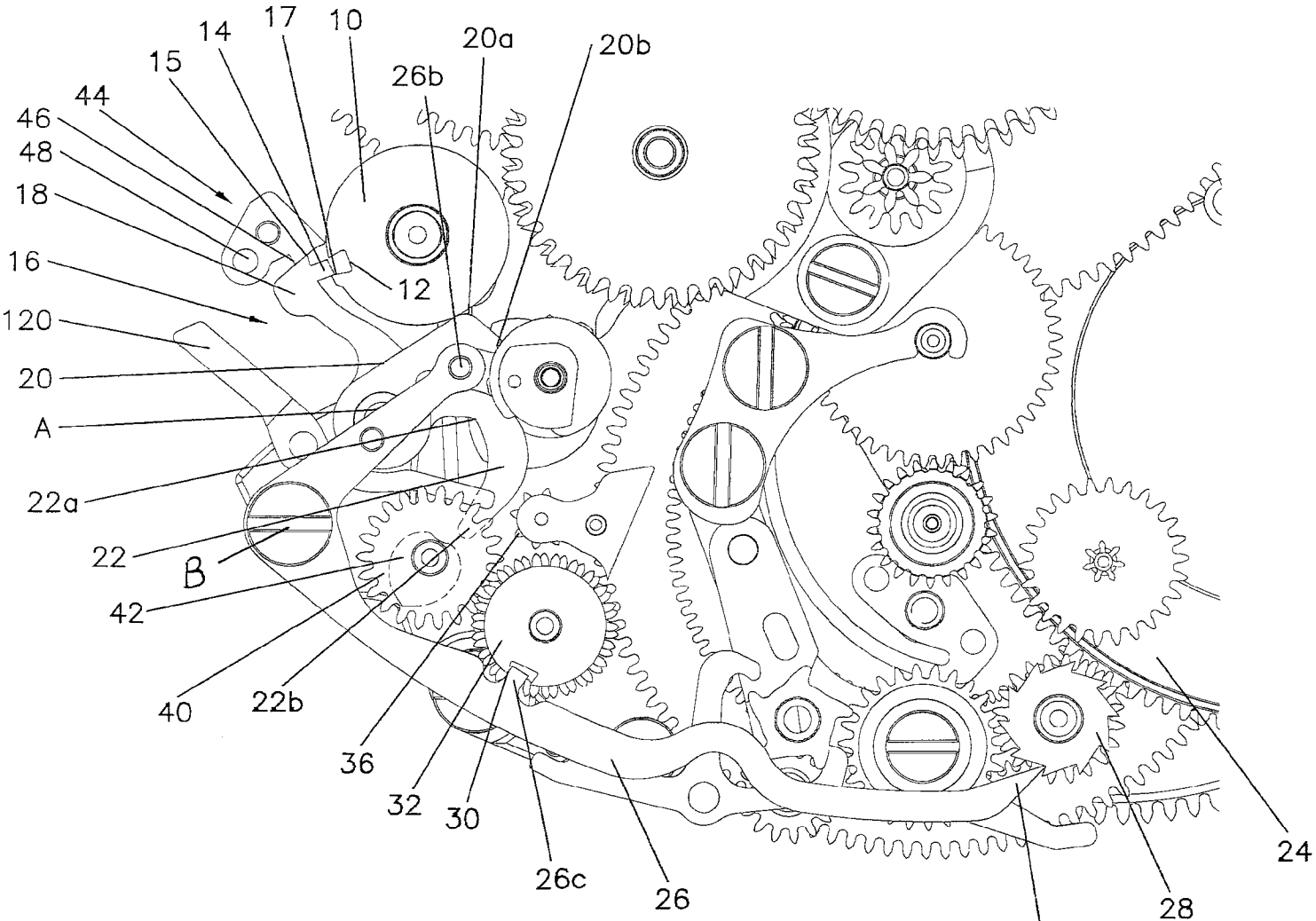
FIGS. 2 and 3 are enlarged views of the part managing, respectively, triggering and the vibrating part of the mechanism.

The mechanism comprises a trigger system, better visible in FIG. 2, comprising only one cam 10 provided with only one slot 12 connected to the going train and rotating clockwise. This cam performs one revolution every twenty-four hours. The slot 12 is intended to cooperate with a pin 14 of a control member 16 described below. A spring, not illustrated, exerts a force pushing the pin 14 against the cam 10. The downstream edge of the slot is slightly higher than the upstream edge and forms a pallet 17.

Thanks to a traditional device for adjusting the alarm time, the cam 10 is positioned such that, at the alarm time chosen by the wearer, the slot 12 finds itself across from the pin 14. The fact that the trigger system causes only one pin to cooperate with only one slot makes it possible to greatly improve precision relative to a traditional system described in the abovementioned work, in which it is necessary to align three pins and three slots.

The control member 16 comprises three arms, 18, 20 and 22 respectively. They are mounted in rotation around a single point A. The end of the first arm 18 bears the pin 14 and ends with an acute corner 15 forming a fastening member. The second and third arms 20 and 22 are equipped with a bend, 20*a* and 22*a* respectively, and end with a finger, 20*b* and 22*b* respectively.

The alarm mechanism is equipped with its own power source. This source is traditionally made up of a barrel 24 which can be wound manually or automatically.

A lever 26 is mounted in rotation in a point B at the edge of the movement. A first 26*a* of its ends forms a pawl of a wolf tooth gear 28 which maintains the barrel 24 in the armed position. At its second end, the lever 26 bears a pin 26*b* intended to cooperate with the bend 20*a*.

The lever 26 comprises, moreover, a pin 26*c* being placed, at rest, in a slot 30 developed in a counting cam 32, named as such because, as one will understand below, it makes it possible to determine the duration of the alarm.

A gear train located at a lower level relative to the elements already described, connects the barrel 24 to an intermediate mobile located under the counting cam 32, coaxially to it. It is therefore not visible in the drawing. This intermediate mobile is capable of causing the counting cam 32 to rotate through a double pinion 36 which makes it possible to kinematically connect two coaxial and superimposed wheels, or the intermediate mobile and the wheel 32. In one advantageous embodiment, the double pinion 36 is mounted on a lever 38 which can move between a first and second position wherein the double pinion 36 engages or not with the intermediate mobile and the counting cam 32.

In addition to the wheel 32, the counting means include a wheel 40 which meshes with the intermediate mobile. It supports, under it, a heart-shaped cam 42 intended to cooperate with the finger 22*b* of the arm 22.

The mechanism also comprises a hook 44 rotating on the plate. This hook 44 comprises, among others, a beak 46 located near the edge of the cam 10 and a pin 48 whereof the role will appear below.

A long lever 50 is mounted in rotation at the edge of the movement. It cooperates with a control rod of the traditional type serving to correct the alarm time, while one of its ends is located near the pin 48.

When the barrel 24 turns, it drives, through a gear train, a striking mechanism. This striking mechanism comprises a star 51 which turns such that its teeth cooperate with the pallets 52. These actuate hammers 54 which strike gongs 56 to produce a clear and brilliant sound. The hammers 54 generally comprise springs and counter-springs which are not illustrated. Traditionally, an inertia brake, not illustrated, is kinematically connected to the barrel in order to regulate its unwinding and the frequency of the hammer strikes.

In one advantageous embodiment, the pallets 52 are arranged coaxially, as described in patent application no. EP 05102567.4. More particularly, they each have:

- a beak 52*a* which cooperates with the star 51 in order to rotate them,
- a positioning surface 52*b* whereon bears a spring, not shown, to maintain them in their resting position, and
- a pallet 52*c* which acts directly on a pin comprised by the hammers 54 to cause them to strike the gongs 56.

As one will understand below, the pallets can, thanks to their structure, be actuated separately or together, depending on the shape and especially the thickness of the star 51. If this star encompasses the thickness of the two pallets, the relative position of the beaks makes it possible to adjust the gap in the hammer strike time.

Indirectly, the brake controls the duration of rotation of the counting cam 32. It performs one revolution in a period of approximately twenty seconds, which determines, as one will better understand below, the duration of the alarm.

Operation of the Simple Alarm

At rest, the lever 26 locks the barrel 24, kept in the armed position. At the programmed alarm time, the slot 12 arrives across from the pin 14. Thanks to the mentioned spring, the pin 14 falls in the slot and the control member 16 tips in a clockwise direction. The bend 20*a* pushes the pin 26*b* and causes the lever 26 to rotate, thereby unlocking the striking barrel, and lifts the pin 26*c* from the slot 30 of the counting cam 32. The barrel 24 then drives the striking mechanism, particularly the star 51, to notify the wearer that the programmed hour has arrived.

Moreover, the barrel drives the counting cam 32 via the gear train and the double pinion 36. The pin 26*c* bears on the edge of the counting cam 32 during its rotation, which maintains the lever 26 in the lifted position, leaving the barrel unlocked.

The rotation of the wheel 32 drives those of the wheel 40 and the heart-shaped cam 42 in a clockwise direction. This pushes the finger 22*b* and causes the control member 16 to rotate counterclockwise, which results in lifting the pin 14 from the slot 12 and distancing the arm 20 from the pin 26*b*.

To avoid, if the cam 10 has not yet sufficiently turned, the pin 14 falling back into the slot 12 in an untimely manner, the arm 18 rotates until the corner 15 fastens on the hook 44.

When the counting cam 32 has completed one revolution, the pin 26*c* falls back into the slot 30. The lever 26 falls back and its end 26*a* once again blocks the barrel, thereby stopping the alarm.

The cam 10 continuing its rotation, the pallet 17 crosses the beak 46 of the hook 44 which then rotates and frees the corner 15 of the arm 18. The pin 14 falls back on the edge of the cam 10, ready to fall once again in to the slot, twenty-four hours later.

If the user wishes to modify the alarm time in order to cause it to strike again immediately after a first alarm, while the corner 15 is still fastened on the hook 44, it is first necessary to free the corner 15 so that the pin 14 can once again fall into the slot 12. To change the alarm time, the user must pull on the control rod. This drives the lever which pushes the pin 48 and causes the hook 44 to rotate. The corner 15 is freed and the pin falls back on the cam 10, while waiting to fall into the slot 12.

Figure 3:
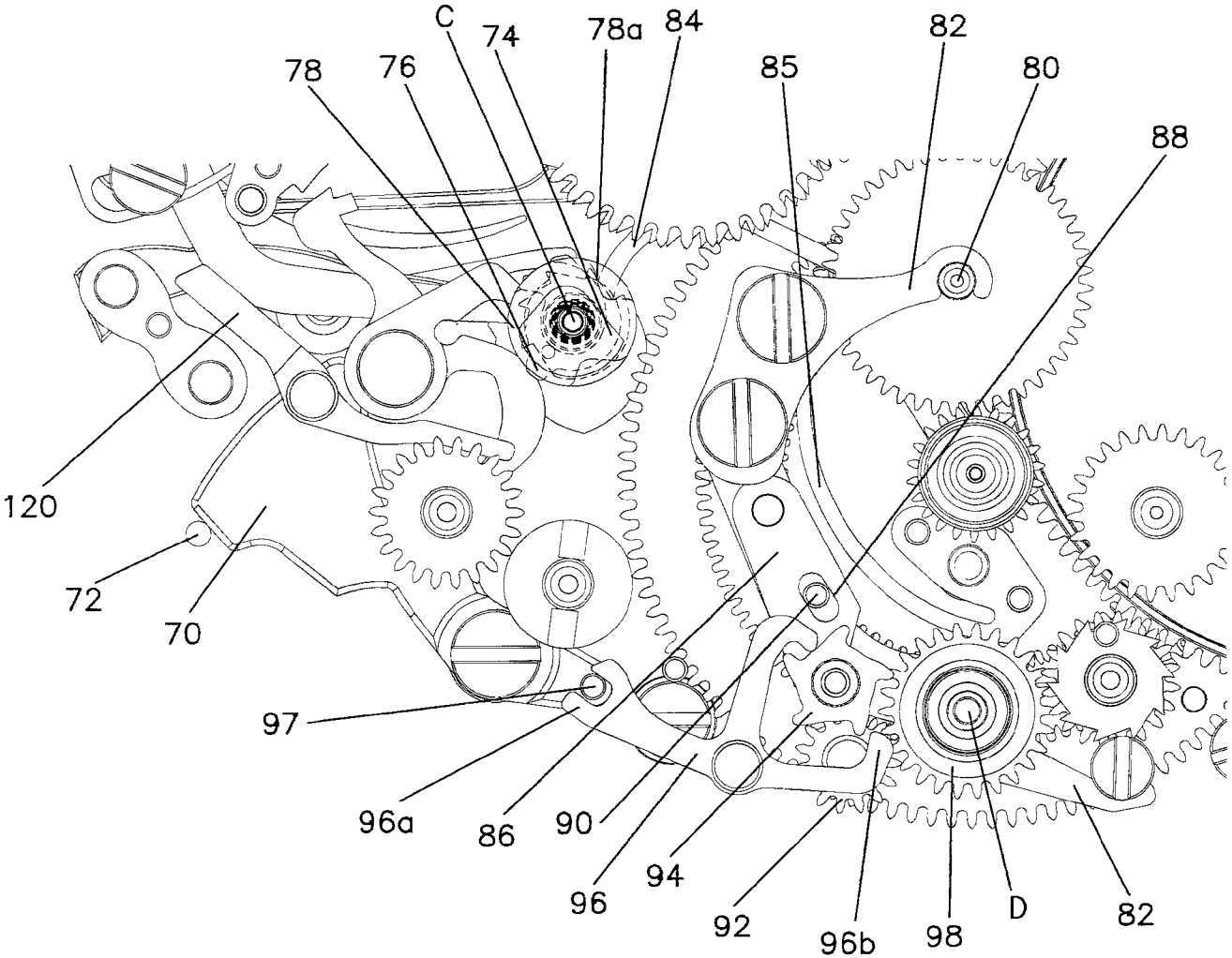

Multi-Modes and Vibrator (FIG. 3)

Advantageously, the alarm striking mechanism can be deactivated, which constitutes a mode referred to as "silent". Likewise, in one particular embodiment, the alarm mechanism includes a device which enables it to operate in a mode called "discreet", meaning that the alarm does not implement the gongs and hammers described above, but a hammer 70 striking a non-resonant object, for example a pin 72 fixed in the back of the case.

To choose one or the other of these modes and activate the corresponding function, the wearer must select it. This selection is obtained by stacking several cams arranged on only one axis C. Through a control member chosen by one skilled in the art, the wearer rotates this axis C, putting one or the other of the cams into operation.

A cam 74 making it possible to activate the silent mode is round and comprises two pins 76. These pins 76 cooperate with the finger 20*b* of the arm 20 to prevent the control member 16 from rotating and thereby maintain the pin 14 disengaged from the slot 12. One of the pins 76 is positioned in contact with the finger 20*b* when the silent mode is selected, the other pin 76 constitutes a safety when the wearer adjusts the alarm time. Indeed, one particular mode is attributed to adjustment of the alarm time, which makes it possible to avoid any untimely striking when the alarm time crosses the current time.

A cam 78 which makes it possible to activate the discreet mode is round and comprises a recess 78*a*.

In this embodiment, the gear train connecting the barrel 24 to the star 51 comprises a sliding pinion 80, directly engaged with the barrel. The pinion 80 is mounted at one end of a first lever 82 rotating in a point D. A sensing arm 84 is assembled linked with the lever 82 and cooperates with the cam 78.

A spring 85 is assembled linked with the plate and exerts pressure on the lever 82 aiming to cause the sensing arm 84 to bear on the cam 78.

A second lever 86 is mounted rotatably, by a first of its ends, on the first lever 82. It is provided with an oblong opening 88 oriented in the direction of the length of the lever 82. One pin, 90, linked with the plate, takes position in the opening 88. At its second end, the lever 86 bears a pinion 92 which, as one will understand below, is made sliding by the combined movements of the two levers 82 and 86. This sliding pinion 92 meshes permanently with the pinion of a to-and-fro cam 94.

A to-and-fro intermediate wheel 96 is provided, on one side, with a fork having two teeth 96*a* and, on the other side, with two stiff arms 96*b* arranged in the shape of a claw. The intermediate wheel 96 is assembled rotationally on the plate at the intersection of the two arms 96*b*. One, then the other of the ends of these arms cooperate with the cam 94, causing tipping in one direction, then the other of the intermediate wheel 96 and transmitting an oscillating movement to the fork 96*a*.

The hammer 70 bears, in one place offset relative to its point of rotation, a pin 97 lodged between the two teeth of the fork 96*a*. The oscillation of the fork 96*a* is therefore transmitted to the hammer which will strike the pin 72. The spring (not illustrated) of the hammer 70 facilitates the oscillating movement by strengthening the return of the arms 96*b* at the contact of the cam 94.

A gear train directly meshed with the barrel ends near a pinion 92 through a toothed gear 98 rotating at point D.

Moreover, when the vibrating mode is activated, one understands that it is necessary to disconnect the normal alarm. As one can see in FIG. 1*b*, in this embodiment, the star 51 is assembled on a lever 100. A spring 101 presses the lever 100 against a banking 102 such that its teeth can cooperate with the pallets 52.

The banking 102 is made up by the end of an additional lever 104 positioned at the edge of the movement. The other of its ends, which forms a sensing arm 106, cooperates with a cam arranged on the axis C. When the normal alarm is active, the sensing arm 106 is in a hollow part of the cam, and the lever 104 lets the spring push the star 51 into contact with the pallets 52.

Thus, in discreet mode, the sensing arm 106 is in a full part of the cam, the lever 104 stresses the spring 101 and pushes the star 51 outside contact with the pallets. Simultaneously, the sensing arm 84 is pushed into the recess 78*a* of the cam 78 and the lever 80 has rotated, disengaging the sliding pinion 80 from the barrel 24. The second lever 86 rotates and, under the effect of the pin 90 on which the opening 88 slides, the sliding pinion 92 has relative forward movement and meshes with the toothed wheel 98.

When the current time indicates the time programmed for the alarm, the striking barrel is freed, as described above. It then causes the toothed wheel 98 to rotate and actuates the hammer 70 at a high frequency, since the brake is disengaged, leading the vibration. The star 51 is also caused to rotate, but it does not cross the pallets 52 and therefore does not cause the gongs to ring.

Stopping the Alarm During Operation

The alarm mechanism comprises a device which makes it possible to stop the alarm during operation. This device is visible in FIGS. 1*a* and 4. It comprises a button housed in the middle of the watch case, for example at 10 o'clock. This button is directly connected to a setting wheel 112 mounted in translation and which ends in a first 114 and a second 116 finger, each equipped with a pin 114*a* and 116*a*.

The pin 114*a* is located in contact with an inclined plane 118 provided on the lever 38. The plane 118 is oriented such that the force exerted by the pin 114*a* when the setting wheel 112 moves, causes the lever to move to its first position, meaning that said lever is disengaged from the intermediate setting wheel and the counting cam 32.

The pin 116*a* is positioned near a lever 120, mounted rotatably in the plate, so as to act on a first of its ends 120*a*. Next to its second end 120*b*, the lever 120 is located at the level of the heart-shaped cam 42. At rest, the lever 120 is in contact with the two shoulders of the heart, thereby defining the stable position of the cam 42. The counting cam 32 is positioned such that the pin 26*c* is across from the slot 30 when the heart-shaped cam 42 is in its stable position.

As one skilled in the art knows, if the heart-shaped cam is not in its stable position, a pressure exerted by the lever 120 automatically returns it to its initial position. This pressure is obtained when the setting wheel 112 moves, the pin 116*a* causing the lever 120 to wobble, which then bears on the cam 42.

Thus, when, during the alarm, the wearer wishes to interrupt it, he presses the button 110, which causes the translation of the setting wheel 112.

As explained above, the pin 114*a* then exerts pressure on the lever 38 which causes it to disengage from the counting cam 32. The rotation of this counting cam is therefore stopped, the pin 26*c* bearing on the edge of the wheel 32, which thereby leaves the striking barrel unlocked.

Simultaneously, the pin 116*a* exerts pressure on the lever 120, which then returns the cam 42 to its stable position. The counting cam 32 is also driven, through the wheel 40 and the intermediate mobile, in its resting position. The pin 26*c* then falls back into the slot 30. The lever 26 rotates in turn, its end 26*a* thereby blocking the pawl wheel 28 and the unwinding of the barrel 24.

Of course, a spring or other elastic system then brings the setting wheel back to its initial position. The lever 38 may then, under the effect of a spring, not shown, resume its normal position wherein the double pinion 36 meshes with the intermediate mobile and the counting cam 32.

Safety During Adjustment of the Current Time

It has been described above that, when the wearer of the watch adjusts the alarm time and this time crosses the current time, a device prevents the alarm from being triggered. Likewise, it is desirable to block the alarm when the wearer adjusts the current time and this time crosses the alarm time.

To do this, the lever 50 passes near the arm 22 of the control member 16. More particularly, the lever is provided with a pin 50*a* located at the level of the bend 22*a* and able to cooperate with it. In normal operation, the pin 50*a* does not hinder the travel of the control member 16. However, when the wearer pulls the control rod to adjust the current time, the lever 50 is then driven and the pin is brought into contact with the bend 22*a*. As such, if during adjustment of the time, this time crosses the alarm time, the pin 14 cannot fall into the slot, as the pin will prevent the control member 16 from rotating.

Alarm with Minute Repeater

Figure 4:
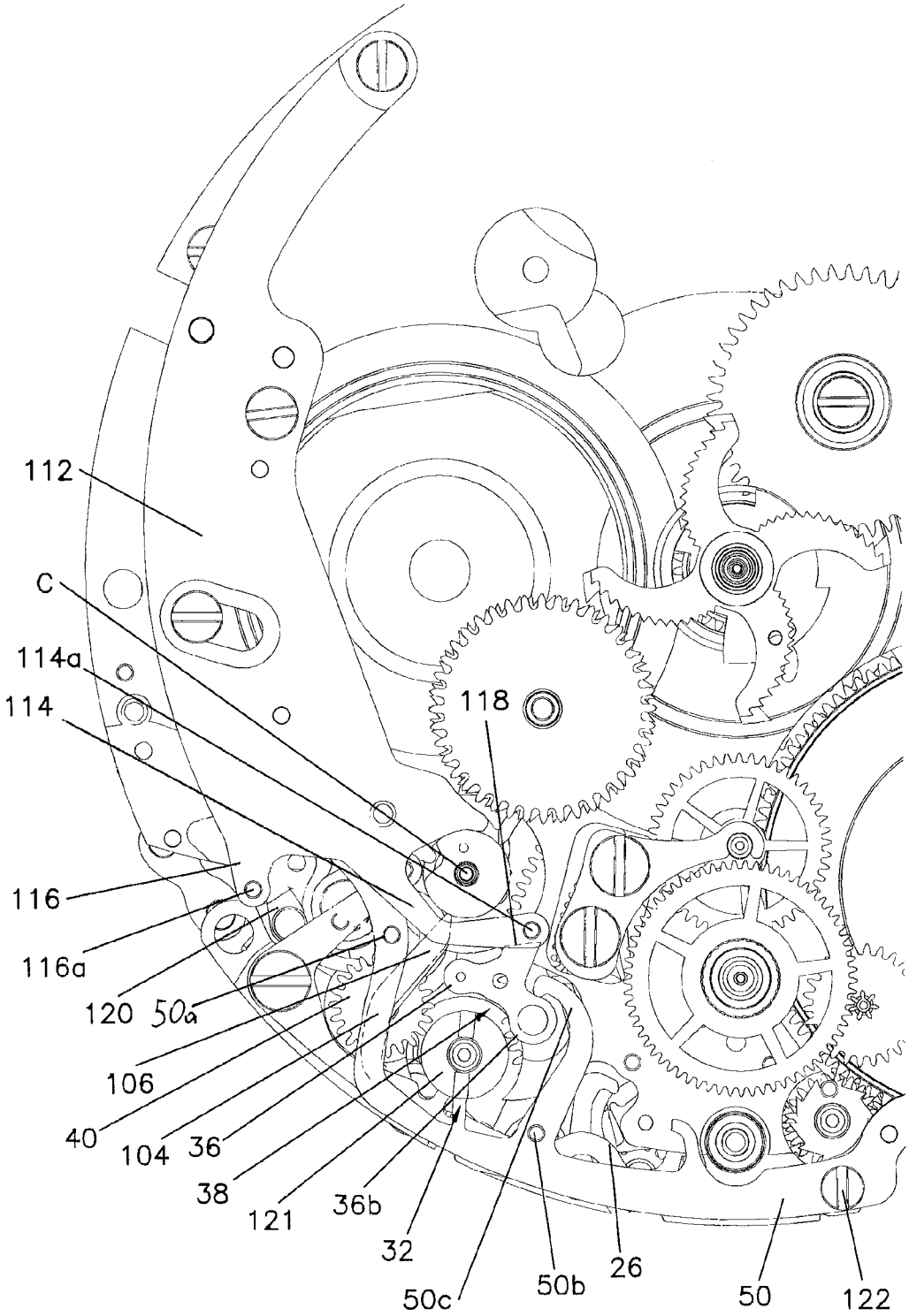
FIG. 4 is a view of the mechanism in a variation integrating an alarm mechanism and a minute repeater mechanism.

In one particular embodiment illustrated in FIG. 4, the alarm mechanism which has just been described is coupled with a minute repeater mechanism, for example that described in the abovementioned application. Certain adaptations are obvious for one skilled in the art and need not to be described in detail.

Thus, the two mechanisms draw their driving power on the same striking barrel 24, governed by the inertia brake. The barrel is still locked and unlocked through the lever 26. When the repeater is in operation, the lever 26 is lifted by a pin 50*b* disposed on the lever 50 which rotates when the minute repeater is actuated.

Like the alarm, the repeater also has a counting cam 121. This is provided with two slots and is disposed coaxially to the wheel 32. The lever 38 is provided, in addition to the double pinion 36, with a second double pinion 36*b* which kinematically connects the intermediate wheel to the counting cam of the repeater. Thus, at rest, the lever 38 is in its first position and the double pinion 36 makes it possible to drive the counting cam 32 of the alarm. When the repeater is actuated, a hook 50*c* disposed on the lever 50 returns the lever to its second position. The double pinion 36*b* then makes it possible to drive the counting cam of the repeater.

The two mechanisms also share the striking mechanism, particularly the gongs 56 and the hammers 54. However, there are three pallets 52, still disposed coaxially.

The upper and lower pallets are identical and both act on the same hammer, through a pin linked with the hammer of sufficient size. The upper pallet is actuated by the toothed sections for the hours and quarters of the minute repeater. The lower pallet is actuated by the star 51 of the alarm. The intermediate pallet has a thickness enabling it to be actuated both by the toothed sections of the minutes and quarters of the minute repeater and by the star 51.

Moreover, when the alarm is in discreet mode and the user wishes to actuate the minute repeater, it is essential for a device to allow one to engage the brake. This is done using a rod 122 linked with the lever 50 and intended to cooperate with the end of the lever 82 which does not bear the pinion 80.

When the user pushes the button 110 to actuate the repeater, the lever 50 rotates and the rod 122 pushes the end of the lever 82. This lever 82 is then forced to turn, driving the disengaging of the sliding pinion 92 of the vibrator and the meshing of the pinion 80 on the brake. The minute repeater can then ring normally.

Thus an alarm mechanism is proposed which is free of the drawbacks mentioned in the introduction. The description has only been provided for information and non-exhaustively. Indeed, one skilled in the art may easily use the technical instruction provided above in order, for example, to produce an alarm possessing only a discreet alarm. It is also unnecessary for the brake to be disengaged during this discreet alarm. One skilled in the art may provide for a simplified mechanism wherein the brake is always engaged. If necessary, there is no need to provide for the reengagement of this brake upon activation of the minute repeater. It is, likewise, obvious that other solutions may be used to control the duration of the alarm, such as a cam and sensing arm system or another equivalent of the pin and slot. Moreover, it is clear that the cam 10 may include n slots regularly distributed around its edge, if it is driven at a rate of one revolution n times every twenty-four hours.

What is claimed is:

1. A timepiece which is equipped with an alarm mechanism comprising:

a power source which is locked when the mechanism is at rest and which is unlocked when the mechanism is in operation, an adjustment system which can be used to program the alarm time, a trigger system comprising a control member which controls the unlocking of the power source and a cam which is kinematically connected to the movement and which performs one revolution every twenty-four hours, wherein said alarm mechanism also comprises a first striking mechanism which is equipped with at least one hammer that is intended to strike at least one gong and a second striking mechanism which is equipped with at least one hammer that is intended to strike at least one non-resonant object, said power source driving one or the other of the striking mechanisms.

2. The timepiece as claimed of 1, wherein the second striking mechanism also comprises a pinion kinematically connected to a power source, a to-and-fro cam driven by said pinion, to-and-fro intermediate wheel kinematically connecting said pinion and said hammer, transforming a rotational movement of said to-and-fro cam into an oscillation of the hammer.

3. The timepiece of claim 2, wherein said intermediate wheel is mounted rotatably and is equipped, on one side, with a fork having two teeth between which is lodged a pin linked with said hammer and, on the other side, two stiff arms arranged in the shape of a claw, one end and then the other of which cooperate with the to-and-fro cam, causing tipping in one direction, then in the other of said intermediate wheel and transmitting an oscillation movement to the fork.

4. The timepiece of claim 1, wherein the alarm mechanism comprises an inertia brake which controls the supply of power from the power source, wherein said alarm mechanism comprises an engaging device for the brake, arranged so as to engage said brake when the first striking mechanism is active and to disengage it when the second striking mechanism is active.

5. The timepiece of claim 2, wherein the alarm mechanism comprises an inertia brake which controls the supply of power from the power source, wherein said alarm mechanism comprises an engaging device for the brake, arranged so as to engage said brake when the first striking mechanism is active and to disengage it when the second striking mechanism is active.

6. The timepiece of claim 3, wherein the alarm mechanism comprises an inertia brake which controls the supply of power from the power source, wherein said alarm mechanism comprises an engaging device for the brake, arranged so as to engage said brake when the first striking mechanism is active and to disengage it when the second striking mechanism is active.

7. The timepiece of claim 4, wherein the device for engaging the brake comprises a sliding pinion kinematically connecting said power source to the brake.

8. The timepiece of claim 7, wherein said sliding pinion is mounted on a first lever provided with a sensing arm intended to cooperate with a cam, a spring exerting pressure on said lever to push the sensing arm on the cam.

* * * * *